US006718277B2

(12) United States Patent
Sharma

(10) Patent No.: US 6,718,277 B2
(45) Date of Patent: Apr. 6, 2004

(54) ATMOSPHERIC CONTROL WITHIN A BUILDING

(75) Inventor: Ratnesh Sharma, Union City, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/123,403

(22) Filed: Apr. 17, 2002

(65) Prior Publication Data

US 2003/0200050 A1 Oct. 23, 2003

(51) Int. Cl.[7] ..... G06F 15/00; F24F 7/007; G05D 15/00

(52) U.S. Cl. ..... 702/132; 165/80.03; 236/13; 236/49.3; 361/695; 454/229; 700/41

(58) Field of Search ..... 702/132; 700/41, 700/70, 117, 205; 62/180, 205, 259.2, 263; 236/49.3; 454/187, 229, 256; 73/31.01, 31.02; 361/695

(56) References Cited

U.S. PATENT DOCUMENTS

| | | | | |
|---|---|---|---|---|
| 2,991,405 A | | 7/1961 | Carlson | 318/471 |
| 4,737,917 A | | 4/1988 | Perron | 700/205 |
| 4,823,290 A | | 4/1989 | Fasack et al. | 340/825.01 |
| 5,074,137 A | * | 12/1991 | Harris et al. | 73/31.01 |
| 5,177,972 A | | 1/1993 | Sillato et al. | 62/205 |
| 5,249,741 A | | 10/1993 | Bistline et al. | 236/49.3 |
| 5,290,200 A | * | 3/1994 | Kiser | 454/229 |
| 5,326,028 A | | 7/1994 | Kano et al. | 236/49.3 |
| 5,331,825 A | | 7/1994 | Kim | 62/180 |
| 5,372,426 A | | 12/1994 | Broudy et al. | 374/127 |
| 5,478,276 A | | 12/1995 | Lee | 454/256 |
| 5,506,768 A | | 4/1996 | Seem et al. | 700/41 |
| 5,687,079 A | | 11/1997 | Bauer et al. | 700/70 |
| 5,709,100 A | | 1/1998 | Baer et al. | 62/259.2 |
| 5,769,315 A | * | 6/1998 | Drees | 236/49.3 |
| 5,828,572 A | | 10/1998 | Hasegawa et al. | 700/117 |
| 6,009,939 A | | 1/2000 | Nakanishi et al. | 165/209 |
| 6,080,060 A | | 6/2000 | Larsson | 454/187 |
| 6,283,380 B1 | | 9/2001 | Nakanishi et al. | 236/49.3 |
| 6,296,193 B1 | | 10/2001 | West et al. | 236/1 B |
| 6,574,104 B2 | * | 6/2003 | Patel et al. | 361/695 |

* cited by examiner

*Primary Examiner*—John Barlow
*Assistant Examiner*—John Le

(57) ABSTRACT

A method and system for controlling atmospheric conditions within a building. A conditioned fluid is supplied inside of the building and one or more atmospheric parameters in various locations inside of the building are sensed. An empirical atmospheric map is then generated and compared to a template atmospheric map. Pattern differentials are identified therebetween and corrective action to reduce the pattern differentials is determined. One or more of the quantity, quality, and distribution of the conditioned fluid is varied in accord with the corrective action determination.

24 Claims, 2 Drawing Sheets

ATMOSPHERIC CONTROL WITHIN A BUILDING

CROSS-REFERENCES TO RELATED APPLICATIONS

The present invention is related to the following pending applications: Ser. No. 09/970,707, filed Oct. 5, 2001, and entitled "SMART COOLING OF DATA CENTERS", by Patel et al.; Ser. No. 10/076,635, filed Feb. 19, 2002, and entitled "DESIGNING LAYOUT FOR INTERNET DATA-CENTER COOLING", by Nakagawa et al; and Ser. No. 10/022,010, filed Apr. 16, 2002, and entitled "DATA CENTER ENERGY MANAGEMENT", by Friedrich et al. Each of the above listed cross-references is assigned to the assignee of the present invention and is incorporated by reference herein.

BACKGROUND

The present invention relates to controlling atmospheric conditions within a building. One type of building is a data center that houses numerous electronic packages. Each electronic package is arranged in one of a plurality of racks distributed throughout the data center. A rack may be defined as an Electronics Industry Association (EIA) enclosure and may be configured to house a number of personal computer (PC) boards. The PC boards typically include a number of electronic packages, such as processors, micro-controllers, high speed video cards, memories, semi-conductor devices, and the like. These electronic packages dissipate relatively significant amounts of heat during the operation of the respective components. For example, a typical PC board comprising multiple microprocessors may dissipate approximately 250 W of power. Thus, a rack containing forty (40) PC boards of this type may dissipate approximately 10 KW of power.

The power required to remove the heat dissipated by the electronic packages in a given rack is generally equal to about 10 percent of the power needed to operate the packages. However, the power required to remove the heat dissipated by a plurality of racks in a data center is generally equal to about 50 percent of the power needed to operate the packages in the racks. The disparity in the amount of power required to dissipate the various heat loads between racks of data centers stems from the additional thermodynamic work needed in the data center to cool the air. Racks are typically cooled with fans that operate to move cooling fluid, such as air, across the heat dissipating components, whereas data centers often use reverse power cycles to cool heated return air. The additional work required to achieve the temperature reduction, in addition to the work associated with moving the cooling fluid in the data center and the condenser, often add up to the 50 percent power requirement mentioned above. As such, the cooling of entire data centers presents major challenges beyond those faced with the cooling of individual racks of electronic packages.

To substantially guarantee proper operation and to extend the life of the electronic packages arranged in the racks of the data center, it is necessary to maintain the temperatures of the packages within predetermined safe operating ranges. Operation at temperatures above maximum operating temperatures may result in irreversible damage to the electronic packages. In addition, it has been established that the reliabilities of electronic packages, such as semiconductor electronic devices, decrease with increasing temperature. Therefore, the heat energy produced by the electronic packages during operation must thus be removed at a rate that ensures that operational and reliability requirements are met. Because of the relatively large size of data centers and the high number of electronic packages contained therein, it is often expensive to cool data centers within the predetermined temperature ranges.

Data centers are typically cooled by operation of one or more air conditioning units. The compressors of the air conditioning units typically require a minimum of about thirty (30) percent of the required cooling capacity to sufficiently cool the data centers. The other components, such as condensers, air movers (fans), etc., typically require an additional twenty (20) percent of the required cooling capacity. For example, a high density data center with 100 racks, each rack having a maximum power dissipation of 10 KW, generally requires 1 MW of cooling capacity. Air conditioning units with a capacity of 1 MW of heat removal generally require a minimum of 300 KW input compressor power in addition to the power needed to drive the air moving devices, e.g., fans, blowers, etc.

Conventional data center air conditioning units do not vary their cooling output based on the distributed, location-specific needs of the data center. Typically, the distribution of work among the operating electronic components in the data center is random and is not controlled. Because of work distribution, some components in one location of the data center may be operating at a maximum capacity, while other components in another location of the data center may be operating at various power levels below a maximum capacity. Furthermore, conventional cooling systems typically operate at 100 percent of capacity on a continuous basis, thereby cooling all electronic packages, regardless of need. In other words, data centers are air conditioned on an overall, room-level basis, thereby yielding unnecessarily high operating expenses to sufficiently cool the heat generating components contained in the racks of data centers. Moreover, prior art attempts at cooling use relatively inaccurate and unsophisticated methods of monitoring and adjusting temperature distribution that result in less than optimal data center cooling efficiency.

BRIEF SUMMARY OF THE INVENTION

According to one embodiment of the present invention, there is provided a method of controlling atmospheric conditions within a building. The method includes the steps of supplying a conditioned fluid inside of the building and sensing one or more atmospheric parameters in various locations inside of the building. From the results of the sensing step, an empirical atmospheric map is then generated and compared to a template atmospheric map. Pattern differentials are identified between the empirical and template atmospheric maps, and corrective action is determined to reduce the pattern differentials. Finally, one or more of the quantity, quality, and distribution of the conditioned fluid is varied. According to another aspect of the present invention, there is provided a system for carrying out an embodiment of the method of the present invention.

BRIEF DESCRIPTION OF THE SEVERAL VIEWS OF THE DRAWINGS

Features and advantages of the present invention will become apparent to those skilled in the art from the following description with reference to the drawings, in which.

DETAILED DESCRIPTION OF THE INVENTION

Figure 1:
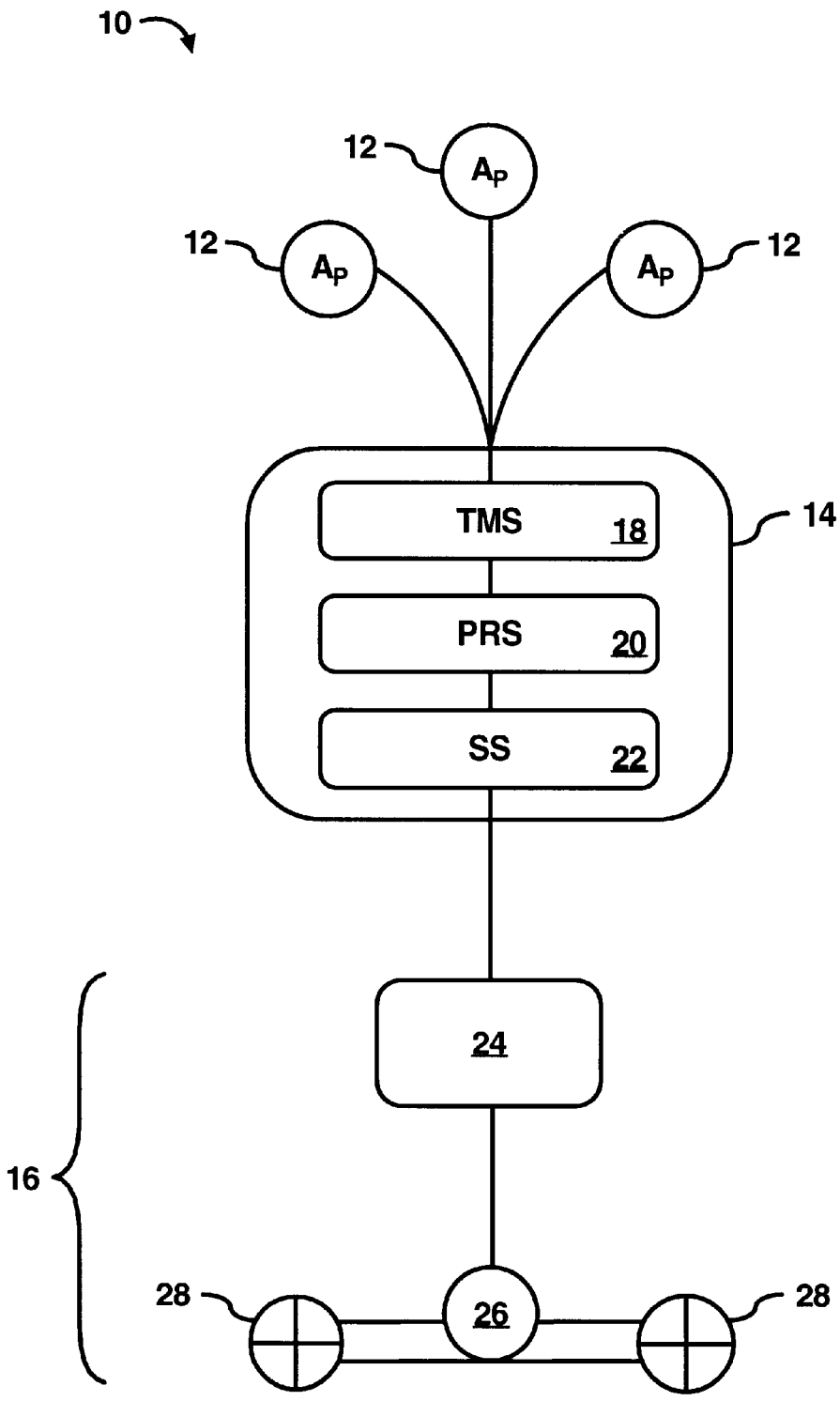
FIG. 1 is a schematic illustration of an embodiment of a system of the present invention.

The present invention is not limited in its application to the details of any particular arrangement described or shown, since the present invention is capable of multitudes of embodiments without departing from the spirit and scope of the present invention. First, the principles of the present invention are described by referring to only a limited number of embodiments for simplicity and illustrative purposes. Although only a limited number of embodiments of the invention are particularly disclosed herein, one of ordinary skill in the art would readily recognize that the same principles are equally applicable to, and can be to implemented in all types of atmospheric control systems. Furthermore, numerous specific details are set forth to convey with reasonable clarity the inventor's possession of the present invention, how to make and/or use the present invention, and the best mode in carrying out the present invention known to the inventor at the time of application. It will, however, be apparent to one of ordinary skill in the art that the present invention may be practiced without limitation to these specific details. In other instances, well known methods and structures have not been described in detail so as not to unnecessarily obscure the present invention. Finally, the terminology used herein is for the purpose of description and not of limitation. Thus, the following detailed description is not to be taken in a limiting sense and the scope of the present invention is defined by the claims and their equivalents.

Generally in accord with the present invention, a method and related system are configured to control one or more atmospheric conditions within a building. More specifically, the method and system are configured to adjust one or more of the quantity, quality, and distribution of a conditioned fluid throughout a data center. The method and system are configured to accomplish such control based upon atmospheric mapping and pattern recognition; using as input, one or more atmospheric parameters measured at various, discrete sensor locations throughout the data center.

In accord with one embodiment of the present invention, the amount of energy typically required to cool a data center may be relatively reduced by strategically distributing cooling fluid, or conditioned air, within the data center by substantially favoring or increasing the cooling fluid flow to locations within the data center having racks that dissipate greater amounts of heat, and by substantially disfavoring or decreasing the cooling fluid flow to locations having racks that dissipate lesser amounts of heat. Thus, instead of operating devices, e.g., compressors, fans, etc., of the cooling system at substantially 100 percent of the anticipated heat dissipation from the racks, those devices may be operated according to the actual location and area specific cooling needs. In addition, the racks may be positioned throughout the data center according to their anticipated heat loads to thereby enable computer room air conditioning (CRAC) units located at various positions throughout the data center to operate in a more efficient manner. In another respect, the positioning of the racks and cooling strategy may be determined through implementation of modeling and metrology of the cooling fluid flow throughout the data center. In addition, the numerical modeling may be implemented to determine the volume flow rate and velocity of the cooling fluid flow through the data center.

Referring specifically in detail to the Figures, there is shown in FIG. 1 a schematic view of the system 10 that may be used in accordance with an embodiment of the present invention. The system 10 generally includes atmospheric sensors 12, a central processing unit (CPU) 14, and an atmospheric control system 16. The atmospheric control system 16 can be a smart cooling system, exemplified by copending U.S. patent application Ser. No. 09/970,707, filed on Oct. 5, 2001, by Patel et al., assigned to the assignee hereof, and incorporated by reference herein in its entirety. Alternatively, it is contemplated that any type of system directed at controlling atmospheric conditions could be employed, including air-conditioner systems, humidifier systems, filtering systems, fire suppression systems, etc.

The atmospheric sensors 12 are used for measuring one or more atmospheric parameter and encompass temperature sensors, such as thermocouples, temperature transducers, thermistors, or the like. The atmospheric sensors 12 could also include humidity sensors, barometric or pressure sensors, fluid velocity sensors, particle sensors, smoke sensors, and the like. The atmospheric sensors 12 are located throughout the portions of a data center type of building (not shown) that are desired to be atmospherically controlled. Specifically, the atmospheric sensors 12 can be positioned in a variety of ways. For example, the atmospheric sensors 12 could be dispersed randomly in various locations and elevations, or aligned according to a predetermined coordinate grid, or placed in alignment with locations of vents and/or racks, or placed in accordance with the recommendations from a computational fluid dynamics model. In any case, it is contemplated that very large data centers, measured in the tens of thousands of square feet, may require thousands of atmospheric sensors 12 spread throughout. The atmospheric sensors 12 are electronically communicated with the CPU 14 either through wiring or via wireless telemetry. In any case, the CPU 14 is capable of keeping track of the location of each atmospheric sensor 12 such that the output of each can be "mapped".

The CPU 14 can be a stand-alone personal computer, a computer board or boards docked within one of the racks in the data center, a computer chip, etc., regardless, the CPU 14 includes various software that is loaded thereto. First, the CPU 14 includes software for generating maps of atmospheric conditions, such as thermal mapping software 18. Thermal mapping software 18 is capable of processing thousands of input data points, such as thousands of sensor signals, and outputting map-like information. For example, a thermal map is composed of temperature contours that define various isothermal regions, or isotherms, of distinct temperatures. The most severe of these isotherms are commonly known as "hot spots". Hot spots may not necessarily correspond in exact location to any given temperature sensor, but may be located between various temperature sensors. Nevertheless, thermal mapping software can extrapolate or triangulate the location of the actual hot spot from the known locations of the temperature sensors. So, if temperature sensors are located in a range of elevations in various latitudinal and longitudinal coordinate positions of a data center, the thermal mapping software can triangulate not only the coordinate position of a hot spot, but also the elevation thereof. The temperature sensor readings provide temperature data and data for calculating temperature gradients, which are used to create a thermal map. In the absence of accurate or comprehensive temperature data, temperature gradients can be used to locate hot spots in the data center by mathematical optimization techniques like steepest gradient, etc. In general, triangulation presents a relatively accurate and efficient approximation technique and, thus, it is possible to use fewer, more sparsely distributed temperature sensors to save on equipment expense and failure modes if desired.

Second, the CPU 14 includes software for recognizing pattern differentials in such maps, more commonly known as pattern recognition software 20. Such software basically involves a decoding process in which discriminations in patterns are made without human intervention. Third, strategic software 22 is loaded on the CPU 14 and is used to determine a course of corrective action to minimize or eliminate the pattern differentials by accepting output of the mapping software 18, processing it, and outputting commands to the cooling system 16. It is contemplated that commercial, general purpose mathematical optimization software like MATLAB could be adapted to generate thermal maps and identify hot spots by pattern recognition. It is also contemplated at this time that application-specific neural network algorithms can also be used to do the same.

In response, the cooling system 16 is used to vary one or more of the quantity, quality, and distribution of the cooling fluid used to cool the data center. The cooling system 16 encompasses a chiller unit 24, but those skilled in the art will recognize that multitudes of other types of cooling systems are generally well-known and available for use with the present invention including, for example, refrigeration systems, cooling tower systems, cooler-condenser systems, and the like. In any case, the cooling system 16 also includes one or more variable-speed air movers or blowers 26, and one or more remotely controlled dampers or vents 28. Those skilled in the art will recognize that ventilation structure connecting the blower, vents, etc. are well known in the relevant art of Heating, Ventilating, and Air Conditioning (HVAC).

It is possible to vary any combination of cooling system control variables to change the quantity, quality, and/or distribution of the cooling fluid and thereby adjust the atmospheric conditions within the data center. For example, chiller cycle can be increased or decreased between 0% and 100% of operating capacity to change the cooling quality of the cooling fluid, i.e. temperature, humidity, particulate count, etc. To change the quantity of cooling fluid, such as conditioned air, the speed and/or baffling of the blower 26 can be adjusted, and the percentage opening of the vents 28 can be varied, either individually or collectively. Also, if the vents 28 include individual blowers (not shown), such blowers could also be adjusted in speed. To change the distribution of conditioned air, one or more of multiple chillers, blowers, and vents can be strategically adjusted to target one or more hot spot locations within the data center. For example, if one corner of the data center is demanding the most significant portion of the cooling needs of the entire data center, then the most proximate chiller(s), blower(s), and vent(s) can be selected, while the other, relatively distant chiller(s), blower(s), and vent(s) can be deactivated or reduced. It is contemplated that any other reasonably foreseen atmospheric control system control variables could also be adjusted.

Figure 2:
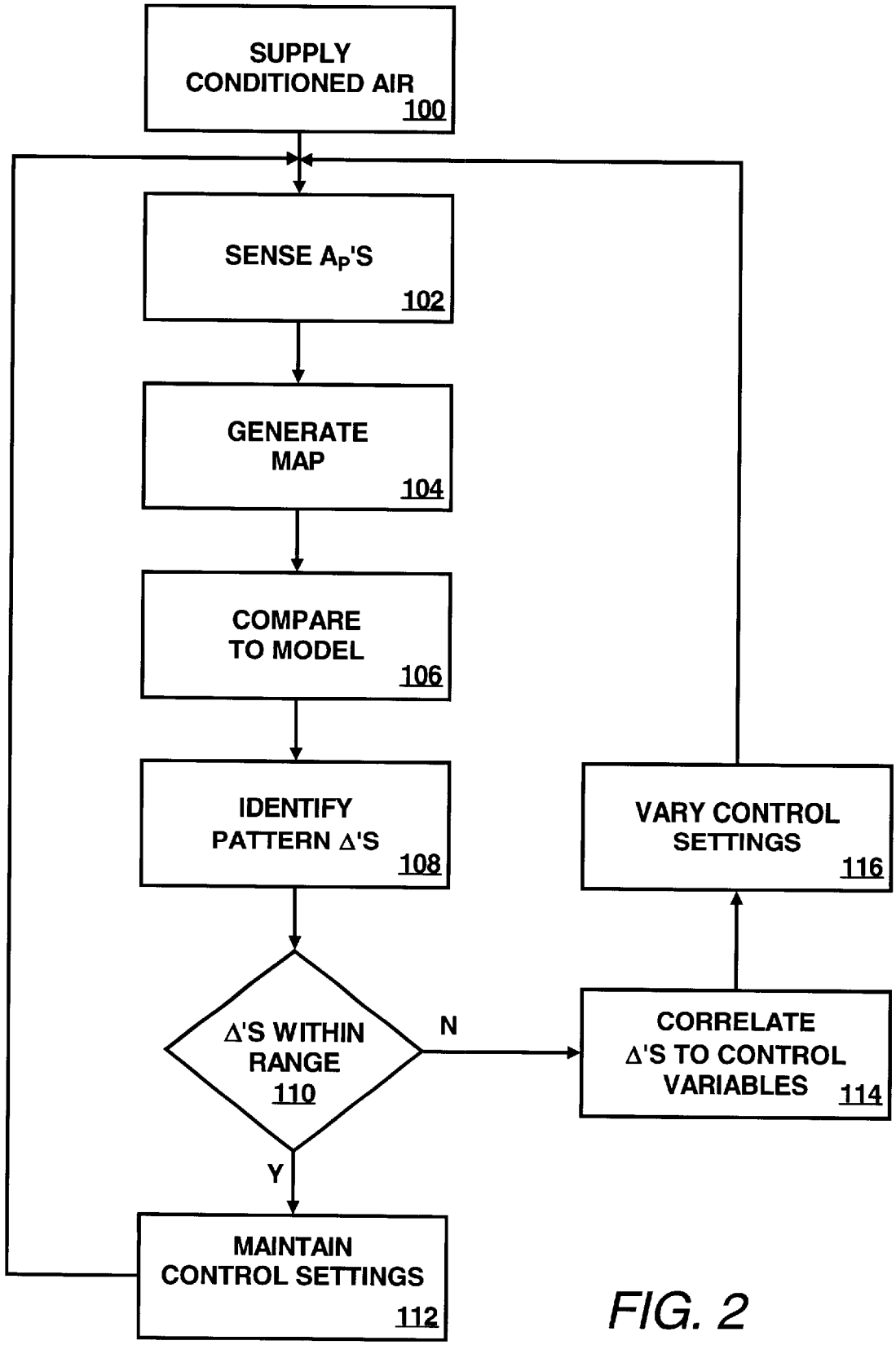
FIG. 2 is a flow chart of an embodiment of a method of the present invention.

Referring now to FIG. 2, in addition to the embodiment described above, an embodiment of a method of the present invention involves cooperation of the CPU between the temperature sensors and the cooling system. The method of the present invention could also be practiced using other systems besides the one disclosed herein, and thus is not limited thereby. The system disclosed herein is simply one of many possible physical manifestations of the method. As discussed previously, the cooling system supplies a cooling fluid within the data center to cool the equipment within the data center, as shown in block 100. In block 102, the temperature within the data center is sensed in various locations and is communicated to the CPU.

The thermal mapping software converts the point-specific temperature sensor data into information by generating an empirical thermal map therefrom, as depicted in block 104. As discussed above, a thermal map can triangulate hot spots from discrete sensor locations based on mathematical optimization techniques. Hot spots are known to arise in several situations, for example, where electronic packages in a given rack draw exceptional amounts of power due to exceptionally high usage of those packages, and the data center cooling system cannot supply enough conditioned fluid to alleviate the overheating. Hot spots may also arise when racks output normal amounts of heat, but the data center cooling system is malfunctioning in a specific location, or in general.

The thermal mapping step may be executed on an instantaneous, snapshot, or sampling basis but, alternatively, this step may be done on a real-time basis. It is also contemplated that the thermal map could be generated directly, without discrete temperature sensors, using thermography technology, based on infrared detection of heat that is emitted by the equipment in the data center. It is further contemplated that the thermal map could be generated by estimating temperature as a function of the power draw to the electronic packages and/or racks within the data center. Thus, the temperature sensing and map generating steps could be accomplished with thermographic equipment and software, or inferring temperature from power draw.

The thermal map also provides a powerful visual tool for a data center operator. A typical data center is a highly thermally interdependent environment where thermal performance of each electronic package of each rack affects performance of neighboring packages and racks to various orders of magnitude. Thus, a thermal map also provides a pictorially informative way of identifying the thermal interdependencies across the data center landscape.

As shown in block 106, the pattern recognition software compares the empirical thermal map to a template thermal map. The template thermal map could also be termed a master, or model thermal map. The template basically represents a thermal map of an optimally operating data center cooling system. The template can be dynamic, generated either in real-time from current operating conditions, or can be static, generated prior to the comparing step 106. Computational fluid dynamics (CFD) software tools, such as FLOVENT/AIRPACK, are widely available and known to those skilled in the art. The CFD tool accepts various inputs for modeling, including heat loads from the racks within the data center, velocity of the cooling fluid flowing throughout the data center, temperature, pressure, and the like in the data center. CFD modeling can be used in the design and layout of a data center, suggesting locations for racks and vents. Alternatively, CFD modeling can be used to output a master, template, or model thermal map to be emulated by adjusting cooling system variables. Instructive in this regard is U.S. patent application Ser. No. 10/076,635, filed on Feb. 19, 2002, and entitled "DESIGNING LAYOUT FOR INTERNET DATACENTER COOLING", by Nakagawa et al., assigned to the assignee hereof and incorporated by reference herein in its entirety.

After, or while, the empirical thermal map is compared to the model thermal map, the pattern recognition software is also applied to recognize pattern differentials therebetween, as depicted in block 108. Pattern recognition is also commonly referred to as template matching, masking, etc. For example, in the case of data center cooling, thermal hot spots can be identified. Once identified, an initial classification step occurs as depicted by block 110. Certain isotherms may exceed a predetermined range of temperature, size, etc., and thus can be targeted for elimination or reduction. Alternatively, if all isotherms are within the predetermined range of temperature, size, etc., then the cooling system simply maintains current operating conditions and settings, as depicted in block 112.

Upon recognizing the pattern differentials, the strategic software is used to determine the corrective action required to eliminate or at least reduce pattern differentials within the data center, as depicted in block 114. Control variable data, such as the location of the vents, the capacity of the blower, and the capacity of the chiller, are used to determine how most efficiently to cool the data center. In addition, the thermal map data is also used, such as the location, size, and intensity of the isotherms. Specifically, the above-mentioned data sets are correlated to develop an optimally efficient course of corrective action.

In block 116, based on the corrective action selected, one or more of the quantity, quality, and distribution of the conditioned fluid of the cooling system is varied. For example, if the size and/or intensity of an hot spot isotherm is relatively small, then the cooling system can merely adjust the opening size of the vent closest to the location of the isotherm. If, on the other hand, the size and/or intensity of an isotherm is relatively large, then multiple vents can be adjusted in addition to increasing the chiller cycle. Similarly, if the cooling system included multiple chillers, the chiller most proximate the isotherm could be increased in cycle. In general, the quantity and/or quality of the cooling fluid can be decreased, or maintained, for locations of the data center that exhibit pattern differentials within a predetermined acceptable range. In contrast, the quantity and/or quality of the cooling fluid may be increased for locations of the data center that exhibit pattern differentials outside of a predetermined acceptable range. Finally, the method is carried out such that the temperature sensing step through the step of varying the conditioned air can be a continuous loop.

Those of ordinary skill in the art will recognize that the present invention is capable of substantially reducing the energy consumption associated with cooling a data center, by virtue of using directed, location-specific cooling instead of diffused, room-level cooling. More particularly, the cooling system can be operated relatively more efficiently compared to the prior art by virtue of a more precise method of tracking and using actual temperature measurement as an input to cooling system control. In other words, the present invention provides methodology for extracting a large amount of discrete, location-specific temperature data points and converting same into more continuous, fluid-like information in the form of a thermal map. The present invention is suited for use with applications requiring thousands of sensors, or even just a few well-placed sensors. Regardless, the present invention enables use of the spaces between the sensor locations to be included in assessing or triangulating the locations, size, and intensity of hot spots, resulting in more accurate hot spot reduction than the prior art allows for. Therefore, compared to the prior art and for a given size data center, the present invention presents a more accurate and efficient cooling method, thus requiring fewer and smaller cooling devices and less energy consumption.

While the present invention has been described in terms of a limited number of embodiments, it is apparent that other forms could be adopted by one skilled in the art. In other words, the teachings of the present invention encompass any reasonable substitutions or equivalents of claim limitations. For example, other modes of carrying out the method steps could be used in addition to those described here, and the method could be practiced independently of the specific system disclosed herein. Those skilled in the art will appreciate that other applications, including those outside of data center cooling, are possible with this invention. Accordingly, the present invention is not limited to only cooling of data centers, but rather applies broadly to many other environmental control systems, including particulate filtering, HVAC, etc. Accordingly, the scope of the present invention is to be limited only by the following claims.

What is claimed is:

1. A method of controlling atmospheric conditions within a building, said method comprising the steps of:

supplying a conditioned fluid inside said building;

sensing at least one atmospheric parameter in a plurality of locations inside said building;

generating an empirical atmospheric map from the results of said sensing step;

comparing said empirical atmospheric map to a template atmospheric map; and identifying pattern differentials between said empirical and template atmospheric maps.

2. The method as claimed in claim 1, further comprising the steps of:

determining corrective action to reduce said pattern differentials; and varying at least one of the quantity, quality, and distribution of said conditioned fluid in accord with said determining step.

3. The method as claimed in claim 2, wherein said supplying step comprises the step of operating a system having at least one of a plurality of vents, at least one blower, and at least one source of conditioned air.

4. The method as claimed in claim 3, wherein said determining step comprises correlating at least one of the location, size, and intensity of said pattern differentials to at least one of the location of said plurality of vents, the speed of said at least one blower, and the capacity of said at least one source of conditioned air.

5. The method as claimed in claim 4, wherein said varying step comprises adjusting at least one of the opening of said plurality of vents, the speed of said at least one blower, and the output of said at least one source of conditioned air.

6. The method as claimed in claim 1, wherein said generating step comprises using thermal mapping software to process input from said sensing step and to produce output in the form of said empirical atmospheric map.

7. The method as claimed in claim 1, wherein said identifying step comprises using pattern recognition software.

8. The method as claimed in claim 1, wherein said plurality of locations of said sensing step comprises locations at various elevations within said building.

9. The method as claimed in claim 1, wherein said sensing step comprises using at least one of temperature sensors, humidity sensors, pressure sensors, particle sensors, smoke sensors, and velocity sensors.

10. The method as claimed in claim 1, wherein the step of generating an empirical atmospheric map comprises generating a map composed of temperature contours that define various isothermal regions.

11. The method as claimed in claim 1, wherein the step of identifying pattern differentials between said empirical and template atmospheric maps comprises performing at least one of extrapolation and triangulation to determine locations of one or more hot spots.

12. A method of cooling a data center having equipment therein, said method comprising the steps of:

supplying a cooling fluid within said data center to cool said equipment within said data center;

sensing temperature within said data center in a plurality of locations;

generating an empirical thermal map of said data center from the results of said sensing step;

comparing said empirical thermal map to a template thermal map; and identifying pattern differentials between said empirical and template thermal maps.

13. The method as claimed in claim 12, further comprising the steps of:

determining corrective action to reduce said pattern differentials; and varying at least one of the quantity, quality, and distribution of said cooling fluid in accord with said determining step.

14. The method as claimed in claim 13, wherein said supplying step comprises operating a system having at least one of a plurality of vents, at least one blower, and at least one source of conditioned air.

15. The method as claimed in claim 14, wherein said determining step comprises correlating at least one of the location, size, and intensity of said pattern differentials to at least one of the location of said plurality of vents, the speed of said at least one blower, and the capacity of said at least one source of conditioned air.

16. The method as claimed in claim 15, wherein said varying step comprises adjusting at least one of the opening of at least one of said plurality of vents, the speed of said at least one blower, and the output of said at least one source of conditioned air.

17. The method as claimed in claim 12, wherein said generating step comprises using thermal mapping software to process input from said sensing step and to produce output in the form of said empirical atmospheric map, wherein said thermal mapping software triangulates locations of hot spots.

18. The method as claimed in claim 12, wherein said identifying step comprises using pattern recognition software.

19. The method as claimed in claim 12, wherein said plurality of locations of said sensing step comprises locations at various elevations within said data center.

20. The method as claimed in claim 12 wherein the step of generating an empirical atmospheric map comprises generating a map composed of temperature contours that define various isothermal regions.

21. The method as claimed in claim 12, wherein the step of identifying pattern differentials between said empirical and template atmospheric maps comprises performing at least one of extrapolation and triangulation to determine locations of one or more hot spots.

22. A system for controlling atmospheric conditions within a building, said system comprising:

means for supplying a conditioned fluid inside said building;

means for sensing at least one atmospheric parameter in a plurality of locations inside said building;

means for generating an empirical atmospheric map from said means for sensing;

means for comparing said empirical atmospheric map to a template atmospheric map; and means for identifying characteristics of pattern differentials between said empirical and template atmospheric maps, said characteristics comprising at least one of location, size, and intensity of said pattern differentials.

23. The system as claimed in claim 22, further comprising:

means for determining corrective action to reduce said pattern differentials; and means for varying at least one of the quantity, quality, and distribution of said conditioned fluid in accord with said means for determining corrective action.

24. The system as claimed in claim 23, wherein said means for supplying comprises an air-conditioning system having at least one of a plurality of vents, at least one blower, and at least one source of conditioned air, further wherein said means for determining comprises means for correlating at least one of the location, size, and intensity of said pattern differentials to at least one of the respective location of said plurality of vents, the speed of said at least one blower, and the capacity of said at least one source of conditioned air, and also wherein said means for varying comprises means for adjusting at least one of said plurality of vents, said at least one blower speed, and said at least one source of conditioned air output, wherein said generating means triangulates hot spots from said sensing means.

* * * * *

UNITED STATES PATENT AND TRADEMARK OFFICE

CERTIFICATE OF CORRECTION

PATENT NO. : 6,718,277 B2
DATED : April 6, 2004
INVENTOR(S) : Sharma

It is certified that error appears in the above-identified patent and that said Letters Patent is hereby corrected as shown below:

Columns 8, 9 and 10,
Please replace claims 1, 12, 17, and 22 with the following claims:

1. A method of controlling atmospheric conditions within a building, said method comprising the steps of:
supplying a conditioned fluid inside said building;
sensing at least one atmospheric parameter in a plurality of locations inside said building;
generating an empirical atmospheric map from the results of said sensing step using software for processing input from said sensing step and for producing output in the form of said empirical atmospheric map;
comparing said empirical atmospheric map to a template atmospheric map; and
identifying pattern differentials between said empirical and template atmospheric maps.

12. A method of cooling a data center having equipment therein, said method comprising the steps of:
supplying a cooling fluid within said data center to cool said equipment within said data center;
sensing temperature within said data center in a plurality of locations;
generating an empirical thermal map of said data center from the results of said sensing step using software for processing input from said sensing step and for producing output in the form of said empirical thermal map; comparing said empirical thermal map to a template thermal map; and
identifying pattern differentials between said empirical and template thermal maps.

17. The method as claimed in claim 12, wherein said generating step comprises using thermal mapping software to process input from said sensing step and to produce output in the form of said empirical thermal map, wherein said thermal mapping software triangulates locations of hot spots.

22. A system for controlling atmospheric conditions within a building, said system comprising:
means for supplying a conditioned fluid inside said building;
means for sensing at least one atmospheric parameter in a plurality of locations inside said building;
means for generating an empirical atmospheric map from said means for sensing, wherein the means for generating comprises software for processing input from said means for sensing and for producing output in the form of said empirical atmospheric map;

UNITED STATES PATENT AND TRADEMARK OFFICE

CERTIFICATE OF CORRECTION

PATENT NO. : 6,718,277 B2
DATED : April 6, 2004
INVENTOR(S) : Sharma

It is certified that error appears in the above-identified patent and that said Letters Patent is hereby corrected as shown below:

Claim 22, cont'd., means for comparing said empirical atmospheric map to a template atmospheric map; and means for identifying characteristics of pattern differentials between said empirical and template atmospheric maps, said characteristics comprising at least one of location, size, and intensity of said pattern differentials.

Signed and Sealed this

Sixteenth Day of November, 2004

JON W. DUDAS
*Director of the United States Patent and Trademark Office*